United States Patent [19]

Hennah

[11] Patent Number: 4,750,348

[45] Date of Patent: Jun. 14, 1988

[54] TRANSFER PRESS SLIDE FINGER OPENING MECHANISM

[75] Inventor: Brian S. Hennah, Twickenham, United Kingdom

[73] Assignee: Platarg Engineering Limited, London, England

[21] Appl. No.: 874,839

[22] Filed: Jun. 13, 1986

[30] Foreign Application Priority Data

Jun. 26, 1985 [GB] United Kingdom ..... 8516188
Nov. 25, 1985 [GB] United Kingdom ..... 8528956

[51] Int. Cl.[4] ..... B21D 43/05
[52] U.S. Cl. ..... 72/405; 72/421
[58] Field of Search ..... 72/405, 419, 422; 198/621; 414/751, 753

[56] References Cited

U.S. PATENT DOCUMENTS

| | | | |
|---|---|---|---|
| 3,754,667 | 8/1973 | Storch | 72/405 |
| 4,186,589 | 2/1980 | Criblez | 72/405 |
| 4,273,507 | 6/1981 | Herdzina | 198/621 |
| 4,404,837 | 9/1983 | Allen et al. | 72/405 |
| 4,428,221 | 1/1984 | Owens | 72/405 |

FOREIGN PATENT DOCUMENTS

| | | | |
|---|---|---|---|
| 1177007 | 9/1985 | U.S.S.R. | 72/405 |

*Primary Examiner*—Robert L. Spruill
*Assistant Examiner*—Donald R. Studebaker
*Attorney, Agent, or Firm*—Browdy & Neimark

[57] ABSTRACT

A transfer press for performing by means of a series of rams and dies, sequential operations on successive workpieces has a reciprocable transfer slide for conveying the workpieces through a series of locations at which the operations are performed, there being provided driven means, which, at or near the forward end of the travel of the slide, mechanically open the transfer slide workpiece engaging devices to release the workpieces as the workpieces are engaged between the corresponding ram tool and associated die and which, at or near the rearward end of the travel of the slide, enable the said devices to engage each of the workpieces, said driven means comprising elements driven from a main drive shaft and mounted on a frame part of the press and workpiece transfer device actuating means carried on the transfer slide and co-operating in readily separable manner with said elements on the frame part.

9 Claims, 5 Drawing Sheets

TRANSFER PRESS SLIDE FINGER OPENING MECHANISM

This invention relates to transfer presses, sometimes referred to as eyelet presses, for cold forming of deep drawn hollow bodies. Such a press comprises a linear series of equally spaced rams and dies, means for reciprocating the rams for projection into and retraction from the respective dies, a top tool fitted to each ram, the dies constituting bottom tools with which the respective top tools co-operate, a transfer slide disposed between the rams and the dies and provided with a series of workpiece transfer devices, means for linearly reciprocating the transfer slide lengthwise with respect to the series of rams and dies whereby, in operation, at or near the end of rearward movement of the slide the workpiece transfer devices engage with respective workpieces acted upon by the rams and the dies to perform a sequence of progressive forming operations thereon whilst, upon forward movement of the slide, the workpiece transfer devices locate each workpiece at the next forward ram and die in the series thereof to enable the next forming operation in the sequence to be carried out thereon. A transfer press "of the kind set forth".

The reciprocation of the transfer slide is effected typically by a transfer cam which is located at the rearward end of the slide and rotation of which effects the requisite slide movements. Also, typically, the rams are reciprocated by cams mounted on a camshaft above the rams, rotation of the cam shaft effecting rotation of the cams which imparts the requisite motion to the rams.

The workpiece transfer devices of the transfer slide each comprise a pair of fingers having at corresponding ends workpiece engaging parts the fingers being biassed to a closed position. To that end, in one form, the fingers are pivotally mounted on the slide for rotary movement about respective axes normal to the slide and are spring biassed to urge the workpiece engaging parts towards one another. In another form, the fingers are mounted on opposite sides of the slide for linear reciprocating movement in opposite senses transversely of the direction of motion of the slide and are spring biassed towards one another.

The workpiece engaging fingers are respectively opened and closed at or near the forward and rearward ends of the travel of the slide in order to disengage one workpiece and engage the next succeeding workpiece. Thus in the forward position of the slide, the workpieces are driven down between and so disengaged from the fingers by the top tool of the ram as the ram is lowered. The transfer fingers thus frictionally rub against the outer surface of the workpiece. Likewise, at or near the rearmost position of the transfer slide, the workpiece engaging fingers are engaged and sprung apart by the ascending workpieces which are carried out of the dies on the upper tools on the rams. Depending on the timing, the workpieces may be at or near their uppermost position and the opening of the slide fingers caused by backward movement of the slide. The lower faces of the fingers are shaped to facilitate such movement. It will be seen however that again frictional rubbing between the outer surface of the workpiece and the fingers takes place.

The rubbing of the outer surfaces of the workpiece caused upon their engagement with and disengagement from the transfer slide fingers causes damage to the surface of the workpieces which may render them of unacceptable quality. The damage so caused is further aggravated as the speed of operation of the press is increased so that the press may have to be operated at speeds well below its capability. Damage can also be caused in this way to the slide fingers which results in further damage to the workpieces.

It is an object of the present invention to provide a transfer press of the kind set forth in which the transfer slide is readily removable and replaceable.

The present invention consists in a transfer press comprising a press frame, a linear series of equally spaced rams and dies mounted on said frame for performing a sequence of progressive workpiece forming operations, means for reciprocating said rams for projection into and retraction from the respective dies, a top tool fitted to each ram, the dies constituting bottom tools with which the respective top tools cooperate, a transfer slide disposed between said rams and dies, a series of workpiece transfer devices mounted on said slide, means for linearly reciprocating said transfer slide between said rams and dies of said series, workpiece transfer device operating members mounted on said slide, an actuating member connected with said operating members for actuation thereof and mounted on said slide, and driven means for operating said actuating member, said driven means comprising a rotatably driven shaft mounted on said press frame and an element reciprocably driven by said shaft which throughout reciprocation thereof contacts said actuating member and which, in the neighbourhood of the end of rearward movement of said slide, effects operation of said workpiece transfer device operating members to engage said workpieces and during forward movement of said slide to transfer said workpieces, each to the next forward ram and die in the series, to release said workpieces thereat, and to maintain said members released from said workpieces during rearward travel of said slide, said driven element and said actuating member being readily separable to enable removal and replacement of said transfer slide.

Advantageously, the transfer device actuating means carried on the slide include a pivotally mounted lever rotation of which in respective opposite senses results in opening and closing of the transfer devices to release and engage the workpieces whilst the elements of the driven means carried on the frame part of the press include a reciprocably driven member which engages said lever throughout the travel of the slide whereby in consequence of movement of the driven member in one sense the lever is pivoted to effect opening of the transfer devices and to hold them open during rearward movement of the slide and, in consequence of movement of the driven member in a reverse sense, the lever is pivoted to enable closure of the transfer devices and maintain closure thereof during forward movement of the slide.

Preferably, the reciprocably driven member includes a plate with which the pivotally mounted lever is engaged and across which the lever traverses during reciprocating movement of the slide.

Suitably, the lever includes a roller which is in rolling contact with the plate of the reciprocably driven member throughout the reciprocal movement of the slide. Contact between the lever and the plate is preferably maintained by the weight of the lever acting under gravity.

Advantageously, the driven elements carried on the frame part of the press include a cam mounted on the main drive shaft of the press and a cam follower carried on the reciprocably driven member, the cam profile being adapted on rotation of the cam to effect the requisite reciprocation of said driven member. In one form the cam is adapted to open the workpiece engaging devices at or approaching the end of the slide motion advancing the workpieces from one to the next ram and die and to maintain the devices open until the slide is returned to enable the devices to engage for advancement the next succeeding workpiece.

Suitably, the transfer slide workpiece engaging devices comprise pairs of rotatably mounted fingers spaced along the length of the slide, the fingers of each pair being spring biassed to a closed position and the actuating means include rotatable rods mounted at respective opposite sides of the slide having crank levers secured thereto, rotation of the rods being effected in consequence of rotation of the lever, the slide having inwardly extending pins which at inner ends thereof respectively engage the fingers and at outer ends thereof are engaged respectively by the crank levers so that rotation of the lever in one sense causes rotation of the rods and of the crank levers to engage and drive the pins inwardly to displace the fingers to an open position thereof whilst rotation of the lever in the reverse sense enables the finger springs to drive the pins outwardly and so reversely rotate the crank levers and rods.

Alternatively the transfer slide workpiece engaging devices comprise pairs of axially displaceable fingers spaced along the length of the slide, the fingers of each pair being spring biassed to a closed position and the actuating means include rotatable rods mounted at respective opposite sides of the slide having crank levers secured thereto, rotation of the rods being effected in consequence of rotation of the lever, the slide having inwardly extending pins which at inner ends thereof respectively engage the fingers and at outer ends thereof are engaged respectively by the crank levers so that rotation of the lever in one sense causes rotation of the rods and of the crank levers to engage and drive the pins inwardly to displace the fingers to an open position thereof whilst rotation of the lever in the reverse sense enables the finger springs to drive the pins outwardly and so reversely rotate the crank levers and rods.

Suitably, the slide fingers are pivotally mounted intermediate opposite ends thereof and the inwardly extending pins respectively engage the ends of the fingers remote from the workpiece engaging ends thereof.

The invention also includes, for use with a transfer press of the kind set forth, a reciprocable transfer slide having pairs of fingers spaced along the length thereof and spring biassed to a closed position and inwardly extending pins which respectively engage the fingers, there being mounted on the slide at respective opposite sides thereof rotatable rods having crank levers secured thereto and adapted upon rotation of the rods in one sense to urge the pins inwardly to displace the fingers to an open position thereof.

Advantageously the slide is provided with cam driven means for effecting rotation of the rods to cause movement of the fingers to the open position thereof, the biassing springs of the fingers effecting return movement of the fingers to their closed position and consequential return rotation of the rods.

The invention will now be described, by way of example, with reference to the accompanying drawings, in which.

Figure 1:
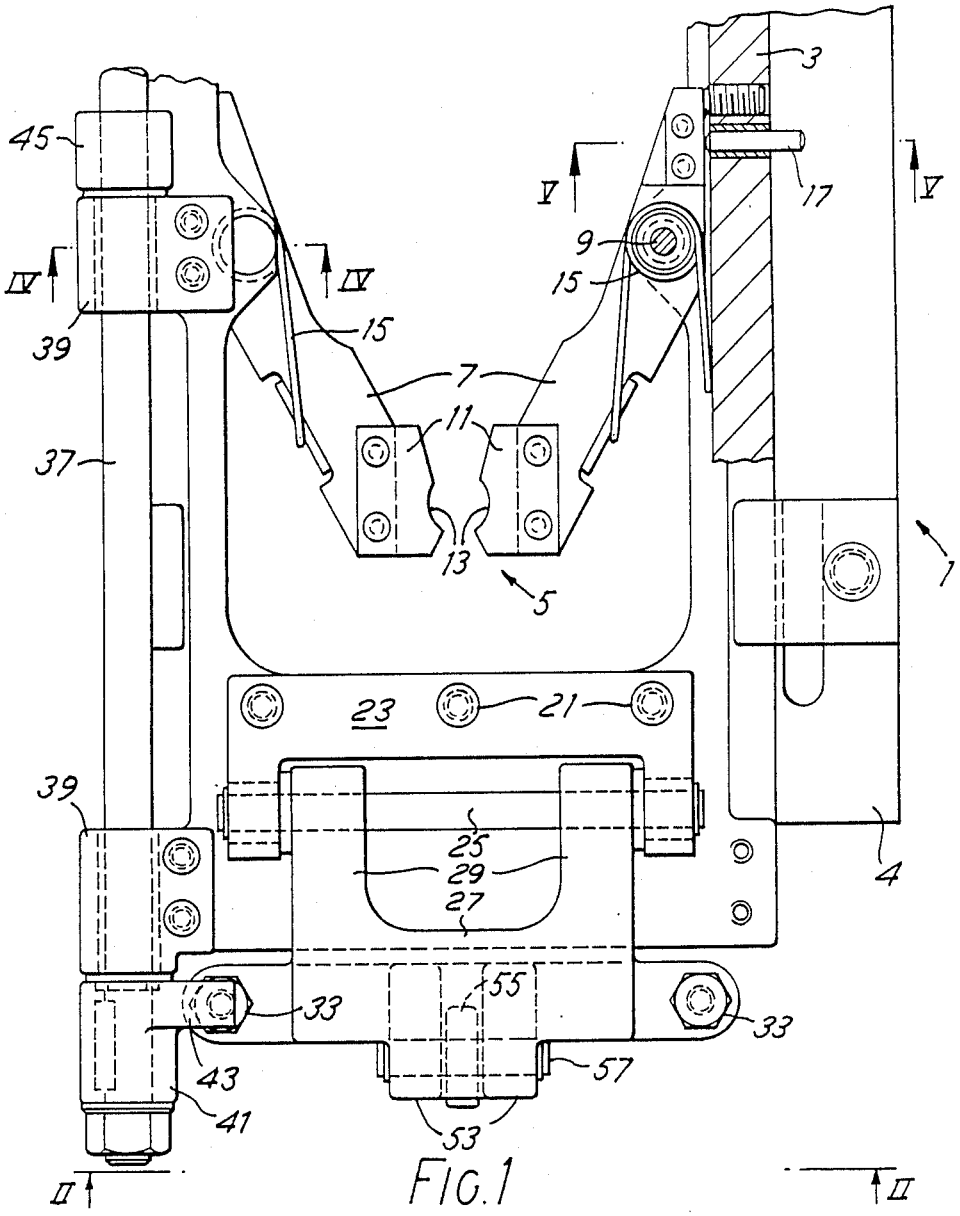
FIG. 1 is a fragmentary plan view of parts of a transfer press of the kind set forth operable in accordance with this invention.
Figure 4:
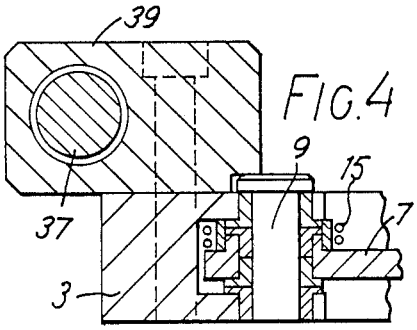
FIGS. 4 and 5 are sectional fragmentary views taken respectively on the lines IV—IV and V—V of FIG. 1 to illustrate details.
Figure 5:
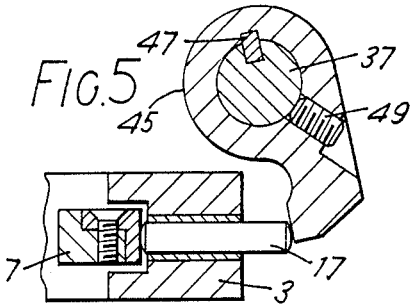

The parts of the transfer press 1 illustrated in the drawings comprise a transfer slide 3 in the form of a rectangular frame having parallel longitudinally extending sides 4 along the length of which are mounted at equally spaced intervals corresponding with the spacing between the axes of successive rams and dies (not shown), workpiece engaging means 5 one only of such means being shown and said means comprising a pair of arms or fingers 7 in the form of levers which are mounted intermediate their ends on pivot pins 9 disposed normal to the slide 3. At their rearward ends the fingers have mounted thereon workpiece engaging elements 11 having inner part cylindrical surfaces 13 which are engagable with complementarily shaped cylindrical surfaces of the workpieces which they advance through the press from one to the next ram and die.

Mounted on the pivot pins 9 are coil springs 15 opposite ends of each of which abut respective surfaces of the slide 3 and finger 7 so that the fingers 7 are biassed inwardly towards a closed position of the workpiece engaging elements 11. Slidably carried in the sides of the slide 3 for movement normal to the direction of motion of the slide are pins 17 which are respectively engaged by the ends of the fingers 7 remote from the elements 11 thereof. Inward movement of the pins, effected as hereinafter described, rotates the fingers 7 against the action of the biassing springs to move the elements 11 to an open position thereof.

At its rearward end, the slide 3 is engaged for reciprocation in a horizontal plane just above the series of dies and below the retracted positions of the rams by a transfer cam (not shown) which co-operates with two cam followers mutually spaced by approximately 180° so that the slide is positively driven throughout its reciprocal movement, whilst at its forward end there is secured, to the sides 4 of the slide by bolts 21, a yoke 23 in which is mounted a pivot shaft 25. The latter has mounted thereon a U-shaped lever 27, through parallel limbs 29 of which extends the pivot shaft 25.

Formed on the lever 27 at opposite sides thereof are respective laterally extending ears 31 in each of which is threadedly engaged a vertical bolt 33 which is engaged at the lower side of the ear 31 by a lock nut 35. Secured to the opposite sides 4 of the slide 3 which are parallel to the direction of travel of the slide are rods 37 secured in bearing blocks 39 which are bolted to the sides 4 of the slide. The rods 37 have keyed thereto at their forward ends sleeves 41 each of which is formed with an inwardly extending lug 43 which overlies the corresponding bolt 33. Thus the effect of rotating the end of the lever 27 remote from the pivot shaft 25 upwardly is to rotate the rods 37 by reason of the engagement of the lugs 43 with the bolts 33.

The rods 37 carry a series of crank arms 45 which are secured to the rods 37 by keys 47 and are also adjustably secured against axial movement with respect to the rods by grub screws 49. Each of the arms 45 is disposed for engagement with one of the pins 17 so that on rotation of the rods 37 resulting from raising of the bolts 33 on lever 27, the arms 45 are rotated to drive the pins 17 inwards and thus effect opening movement of the workpiece engaging elements 11. Upon lowering of the lever 27, the springs 15 cause the fingers 7 to force outwards the pins 17 so that arms 45 rotate the rods 37 in a reverse sense so that contact between the lugs 43 and bolts 33 is maintained whilst the lever 27 is in its lowered position.

The lever 27, centrally between the limbs 29, is formed on the front end of its under surface with a saddle 53 in which a roller 55 is mounted on a shaft 57. The roller 55 engages a plate 59 which is secured to the head 61 of a ram 63 by bolts 65. The plate extends rearwardly from the head of the ram so that contact between the roller 55 and plate 59 is maintained throughout the reciprocal movement of the slide 3.

The ram 63 consists of a body 67 which is bolted to the frame 69 of the press and is formed with a vertical bore 71 lined with a sleeve 73 in which is slidably engaged a rod 75.

At its lower end, rod 75 has secured thereto by a vertical bolt 77, a block 79 which is saddle shaped and formed with depending side plates 81 through which extends a shaft 83 which is keyed to the block 79 by a key plate 85 held to the block by screw 87. Between the side plates 81 there is mounted on the shaft 83 a cage of needle rollers bearings 89 and a cam follower roller 91 which engages with slide finger opening cam 93. To ensure maintenance of contact between the cam and cam follower, four compression springs 95 are located at corners of the block 79 in cylindrical recesses and extend into coaxial recesses in the body 67.

The cam 93 is secured to a boss 97 which is bolted by bolt 99 to the bottom drive shaft 101 of the press. The bottom drive shaft extends through a part 103 of the frame of the press, a thrust bearing 105 being provided between the frame part 103 and boss 97. The bottom drive shaft 101 is driven by an upright side shaft (not shown) which in turn is driven by the main shaft which drives the ram tools.

Figure 2:
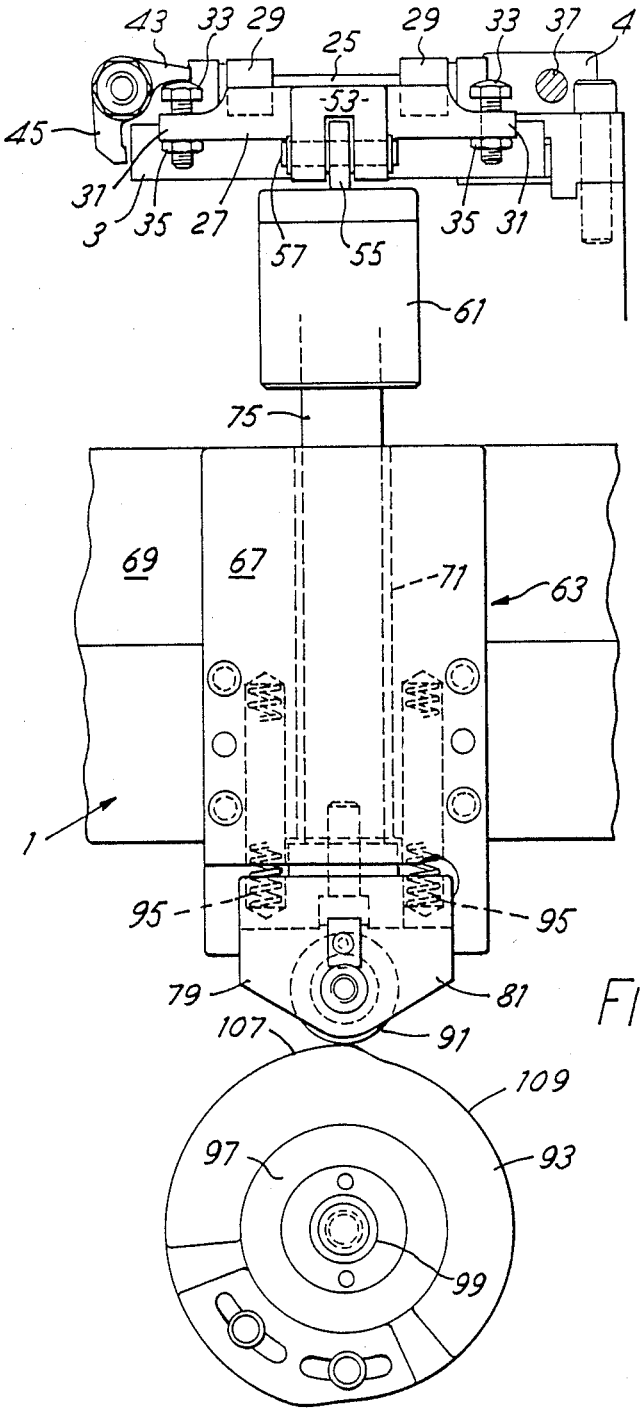
FIG. 2 is an end elevational view partly in section, of the parts of the press shown in FIG. 1 as seen looking on the line II—II of FIG. 1.
Figure 3:
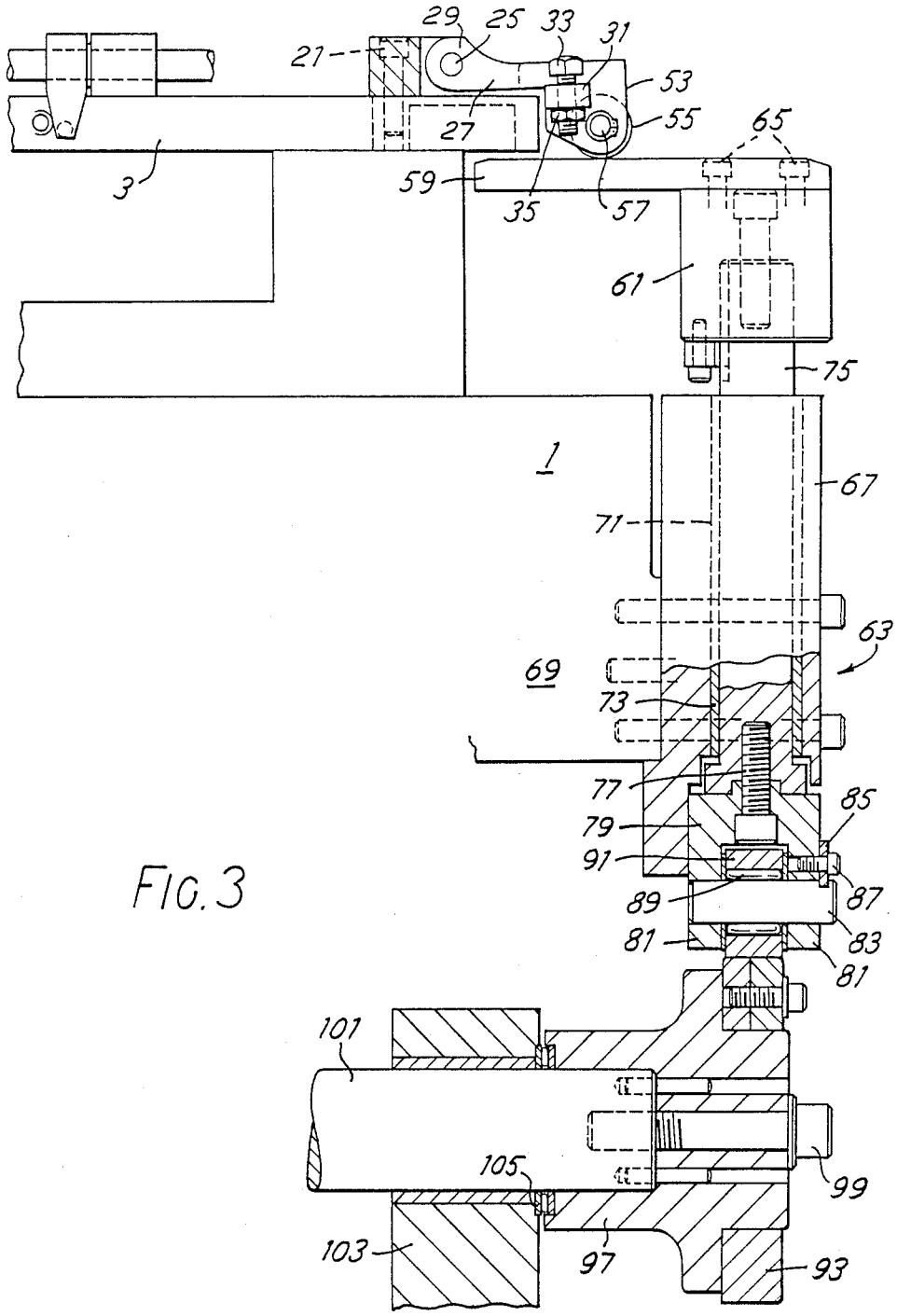
FIG. 3 is a side elevational view, also partly in section, of the parts of the press shown in FIGS. 1 and 2, as seen looking from the left of FIG. 2.
Figure 6:
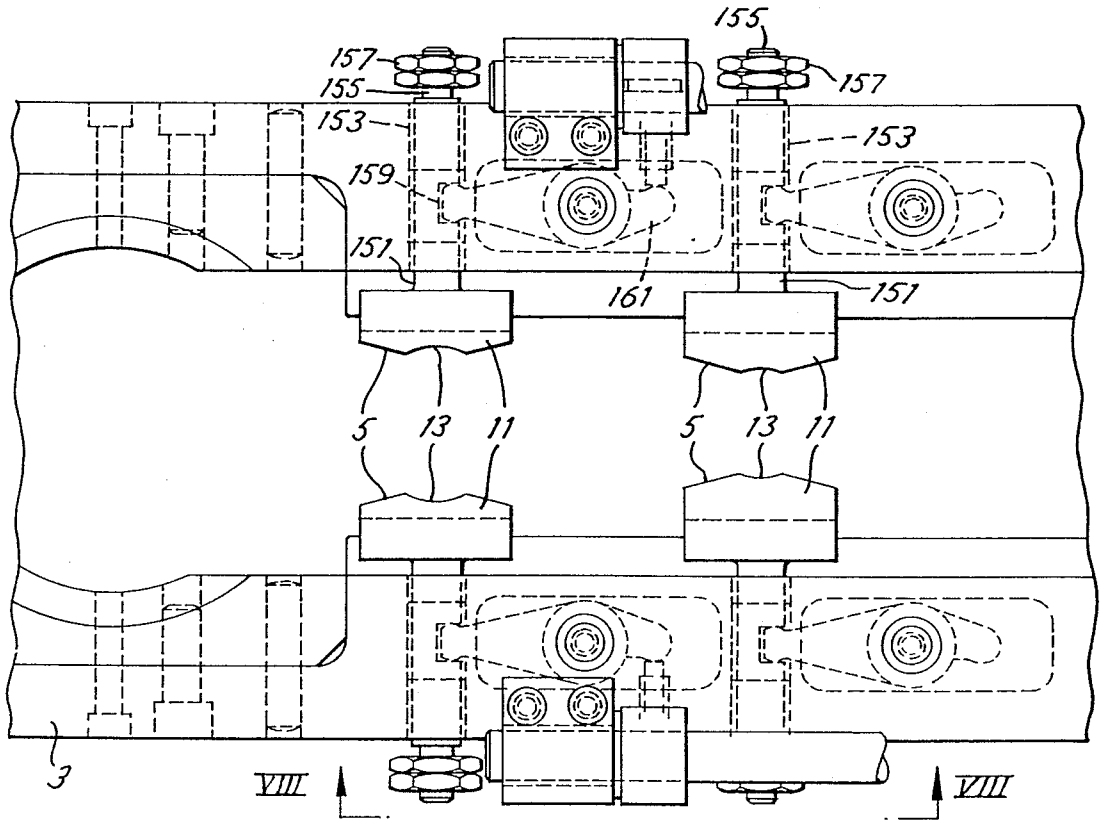
FIG. 6 is a fragmentary plan view of a further embodiment of a transfer slide of a transfer press of the kind set forth.
Figure 7:
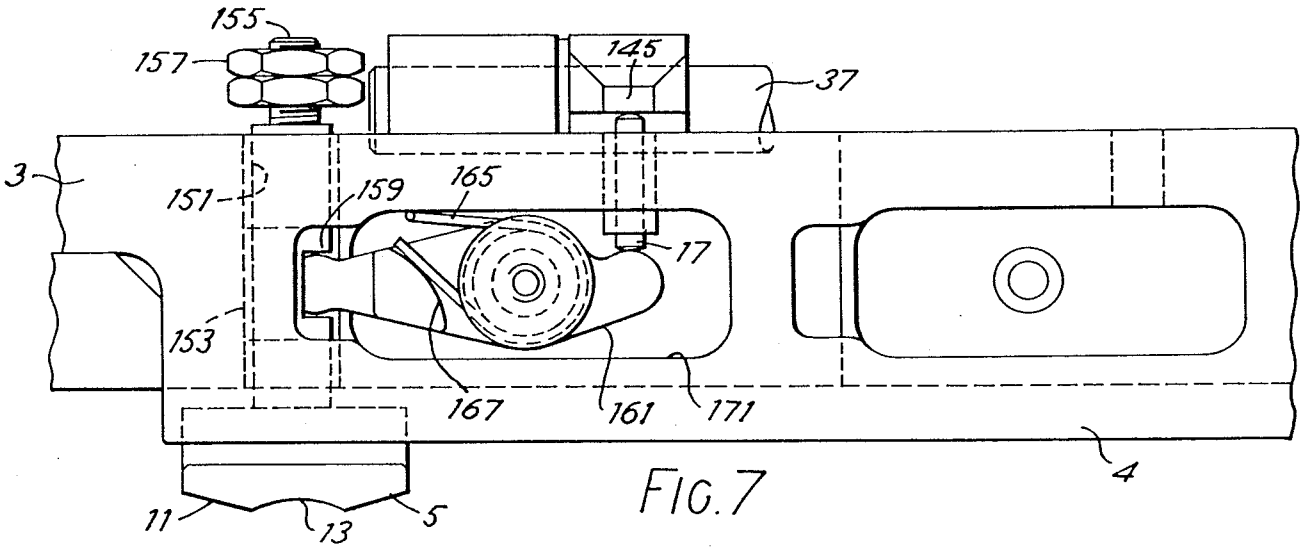
FIG. 7 is a plan view, to a larger scale than FIG. 6, of certain parts of the transfer slide of FIG. 1 showing more details than are illustrated in that view.
Figure 9:
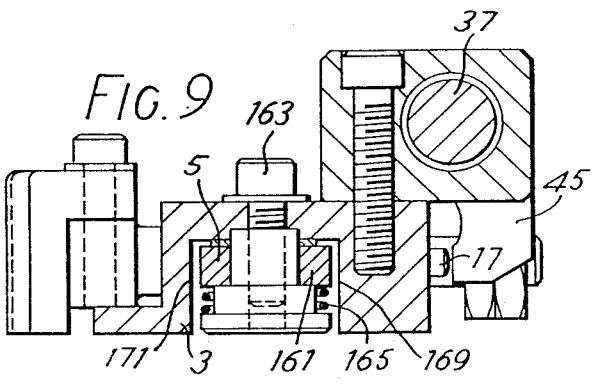
FIGS. 8 and 9 are views of the same scale as FIG. 7 taken on the lines VIII—VIII respectively of FIGS. 6 and 8.
Figure 8:
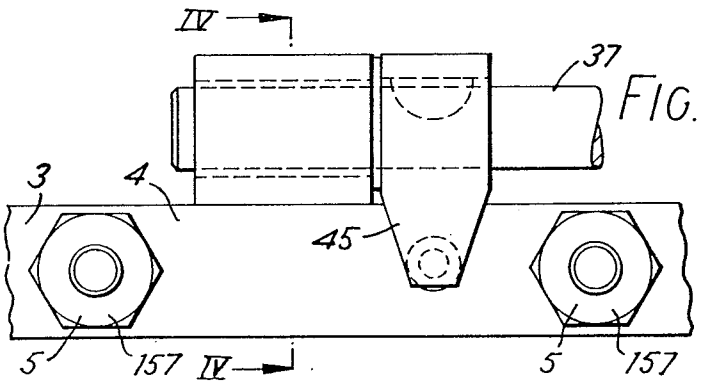

It will be seen from FIG. 2 that the lift profile 107 of the cam extends approximately through 180° of the cam profile. When engaged with the cam lift 107, the follower 91 maintains the lever 27 in its raised position so that the crank arms 45 acting through the pins 17 open the workpiece engaging elements 11 of the fingers 7. When the rotation of the cam 93 transfers the follower 91 to the lower profile 109, the lever 27 is lowered and the crank arms 45 are reversely rotated by the action of the finger springs 15 on the pins 17 so that the elements 11 on the fingers 7 are brought to the closed position thereof.

The setting of the cam 93 in relation to the reciprocal movement of the slide is such that as the slide reaches or closely approaches its rearmost position, the ram tools have raised the workpieces at least partly out of the dies and the cam follower roller, 91 engages the lower profile of the cam so that mechanical closure of the finger elements 11 on the workpiece is effected through the biassing springs 15. This is followed by a stripping mechanism (not shown) of known form operating to ensure positive separation of the workpieces from the ram tools. The finger elements 11 remain closed whilst the slide conveys the workpieces forwards till the forward position of the slide is reached or closely approached. The cam follower 91 now transfers to the higher profile 107 of the cam and the elements 11 of the fingers 7 open and release the workpieces. At this time the ram tools are engaged in the workpieces prior to entering the dies. The finger elements 11 then remain open until the slide again reaches or closely approaches its rearmost position and the lower profile is again engaged to allow the finger elements to close on the workpieces under the influence of the springs 15.

The drawings comprising FIGS. 6 to 9, illustrate mechanism for effecting opening and closing of workpiece engaging means of a transfer press of the same form as is hereinbefore described. In the embodiment described in connection with FIGS. 1 to 5 the workpiece engaging means comprise pairs of fingers 7 each finger being in the form of a lever pivotally mounted intermediate its ends and spring biassed to a closed position so that opening and closing of the workpiece engaging means was effected by rotary movement of the fingers.

In the present embodiment the opening and closing of the workpiece engaging means is by linear reciprocal movement thereof though the means for effecting such movement are the same as are described iN relation to the embodiment of FIGS. 1 to 5. In view of this, parts of FIGS. 6 to 9 which are the same as in the earlier figures have been accorded the same reference numerals.

Referring to the drawings transfer slide 3 has mounted at equally spaced intervals along its length corresponding with the spacing between the axes of successive rams and dies (not shown), workpiece engaging means 5 which each comprise a pair of opposed fingers 7 including workpiece engaging elements 11 having inner, part cylindrical surfaces 13 which are engageable with complementarily shaped cylindrical surfaces of the workpieces which they advance through the press from one to the next ram and die.

Extending rearwardly from and normal to the elements 11 are rods 151 which are slidably engaged each in a bore 153 which extends normal to the side 4 of the slide 3. At its outer end each rod 151 has a threaded section 155 on which is carried a lock nut 157 which is adjustable to enable the stroke of the corresponding rod 151 to be varied.

For affecting linear reciprocation of the workpiece engaging means 5, each rod 151 is formed with a lateral recess 159 in which is engaged one end of a lever 161 which nearer the opposite end thereof is pivotally mounted on a pin 163 normal to the slide. At its end remote from the corresponding rod 151, each lever 161 is engaged by one of the pins 17 which is moved inwards by a crank arm 45 keyed to rod 37 to effect release of the workpiece engaging means from the workpiece engaged therewith, the rod 37 being rotated in the course of reciprocation of the slide 3. Each lever 161 is spring biassed by a spring 165 which embraces the pivot pin 163 and respective ends of which engage an abutment 167 on the lever and a side 169 of an aperture 171 in the slide 3 in which the lever is disposed, the biassing of the spring operating to urge the workpiece engaging means inwards into engagement with the associated workpiece.

As described with reference to the previous embodiment, the rods 37 are reversely rotated to enable re-engagement of the workpiece engaging means 5 with the workpieces. Upon such reverse rotation of the rods 37, each spring 165 rotates its associated lever 161 to move the rod 151 inwardly and to move the corresponding pin outwardly so that contact between the latter and its corresponding crank arm 45 is maintained. The timing of the opening and closing of the workpiece engagement means is effected in the same way and by the same mechanism as described in connection with the embodiment of FIGS. 1 to 5.

The mechanism of the invention is simple to manufacture and since the mechanism for opening and closing the fingers is, apart from the cam drive thereof, mounted on the slide, and since the workpiece transfer device actuating means, namely, the slide finger opening and closing mechanism carried on the slide is only connected to the elements of the drive thereof carried on the frame of the press by the contact between the roller 55 of lever 27 and the plate 59 of the ram 63, fitting of the mechanism to existing machines simply involves changing the slide and mounting the cam drive for the new slide on the shaft 101 and bolting its follower ram assembly to the main frame of the press and making minor modifications to the press bolster. It is further possible if desired, to provide that only selected pairs of fingers on the slide are mechanically opened and closed whlst the rest are opened, as hitherto, by frictional engagement between the fingers and the workpieces.

The mechanism described confers several important advantages on transfer presses of the kind set forth. First, friction between the workpieces and the slide fingers is reduced appreciably with the result that surface damage to the workpieces is reduced as also is damage to the fingers themselves. The use of plastic inserts on the slide fingers is also facilitated because of the reduced friction and their use further reduces surface damage to the workpieces. With spring loaded fingers the faster the press is run the more likely is damage to ensue. The positive opening and closing of the fingers provided by the invention therefore enables high speed running of the press, typically at 240 reciprocations of the slide per minute, whilst avoiding any significant increase in the incidence of surface damage to the workpieces. Also, stronger finger biassing springs can be employed without significantly increasing surface damage to the workpieces. The stronger springs ensure that the fingers do not tend to open during high speed operation as a result of the high speed stopping of the slide at the forward end of its travel. This also enables higher speed operation. frictional engagement between the fingers and the workpieces.

It will be apparent that the timing of the finger opening cam relatively to the slide motion is simply effected and that the handling of workpieces with larger flanges at their open ends is less likely to result in the fingers being trapped below the flanges. Further the invention is equally applicable to slides where the finger motion instead of being pivotal is normal to the direction of slide motion.

I claim:

1. A transfer press comprising a press frame, a linear series of equally spaced rams and dies mounted on said frame for performing a sequence of progressive workpiece forming operations, means for reciprocating said rams for projection into and retraction from the respective dies, a top tool fitted to each ram, the dies constituting bottom tools with which the respective top tools cooperate, a transfer slide disposed between said rams and dies, a series of workpiece transfer devices mounted on said slide, means for linearly reciprocating said transfer slide between said rams and dies of said series, workpiece transfer device operating members mounted on said slide, an actuating member connected with said operating members for actuation thereof and mounted on said slide, and driven means for operating said actuating member, said driven means comprising a rotatably driven shaft mounted on said press frame and an element reciprocably driven by said shaft which throughout reciprocation thereof contacts said actuating member and which, in the neighbourhood of the end of rearward movement of said slide, effects operation of said workpiece transfer device operating members to engage said workpieces and during forward movement of said slide to transfer said workpieces, each to the next forward ram and die in the series, to release said workpieces thereat, and to maintain said members released from said workpieces during rearward travel of said slide, said driven element and said actuating member being readily separable to enable removal and replacement of said transfer slide.

2. A transfer press as claimed in claim 1, characterised in that each of said workpiece transfer devices comprises a pair of fingers mounted on said slide and spring means biassing said fingers towards a closed position thereof. said actuating member is a lever pivotally mounted on said slide rotation of which in one sense effects movement of said transfer device operating members to move said fingers against the action of said spring means for opening of said workpiece transfer device fingers and rotation of which in a reverse sense allows said spring means to return said fingers to the closed position thereof, and said reciprocably driven element contacts said lever throughout the travel of the slide to effect movement of said lever in said one and said reverse senses thereof.

3. A transfer press as claimed in claim 1, characterized in that the reciprocably driven member includes a plate with which the pivotally mounted lever is engaged and across which the lever traverses during reciprocating movement of the slide.

4. A transfer press as claimed in claim 3 characterized in that the pivotally mounted lever includes a roller which is in rolling contact with the plate of the reciprocably driven member throughout the reciprocal movement of the slide.

5. A transfer press as claimed in claim 3 characterised in that contact between the lever and the plate is maintained by the weight of the lever acting under grvity on the plate.

6. A transfer press as claimed in claim 5, characterised in that said driven means comprise a cam mounted on said driven shaft and a cam follower carried on said reciprocably driven element, said cam being adapted on rotation thereof to effect reciprocation of said driven element to open the fingers of said transfer devices at or approaching the end of the slide motion advancing the workpieces from one to the next ram and die and to maintain the devices open until the slide is returned to enable the devices each to engage for advancement the next succeeding workpiece.

7. A transfer press as claimed in claim 2, characterised in that the transfer slide workpiece engaging devices comprise pairs of rotatably mounted fingers spaced along the lenghth of the slide and respective springs biassing the fingers of each said device to a closed position and the workpiece transfer device operating members include rotatable rods mounted at respective opposite sides of the slide, crank levers secured to said rods, rotation of the rods being effected in consequence of rotation of the lever, and inwardly extending pins mounted on the slide which at inner ends thereof respectively engage the fingers of the workpiece engaging devices and at outer ends thereof are engaged respectively by the crank levers so that rotation of the lever in one sense causes rotation of the rods and of the crank levers to engage and drive the pins inwardly to displace the fingers to an open position thereof and rotation of said lever in the reverse sense enables said finger biassing springs to drive the pins outwardly and so reversely rotate said crank levers and said rods.

8. A transfer press as claimed in claim 2, characterised in that the transfer slide workpiece engaging devices comprise pairs of axially displaceable fingers spaced along the length of the slide and respective springs biassing said fingers to a closed position and the workpiece transfer device operating members include rotatable rods mounted at respective opposite sides of the slide, crank levers secured to said rods, rotation of the rods being effected in consequence of rotation of said lever, and inwardly extending pins mounted on the slide which at inner ends thereof respectively cooperate with said fingers and at outer ends thereof are engaged respectively by said crank levers so that rotation of said lever in one sense causes rotation of the rods and of the crank levers to engage and drive the pins inwardly to displace the fingers to an open position thereof and rotation of said lever in the reverse sense enables said finger biassing springs to drive the pins outwardly and so reversely rotate said crank levers and said rods.

9. A transfer press as claimed in claim 1, including a transfer slide adapted for disposition between the rams and dies of said press and comprising workpiece transfer devices having respective pairs of fingers mounted on said slide and spring means biassing said fingers towards closed positions thereof, workpiece transfer device operating members mounted on said slide and an actuating member in engagement with said transfer device operating members for operation thereof, said actuating member being in the form of a lever pivotally mounted on said slide rotation of which in one sense effects movement of said operating members to cause movement of said fingers opposed to the action of said biassing springs and rotation of which in a reverse sense allows said biassing springs to effect movement of said fingers to the closed positions thereof and to cause said transfer device operating members to remain engaged with said lever.

* * * * *